US011312569B1

(12) United States Patent
DeFoe

(10) Patent No.: US 11,312,569 B1
(45) Date of Patent: Apr. 26, 2022

(54) BOTTOM TRASHCAN BIN

(71) Applicant: Venita DeFoe, Lakeland, FL (US)

(72) Inventor: Venita DeFoe, Lakeland, FL (US)

( * ) Notice: Subject to any disclaimer, the term of this patent is extended or adjusted under 35 U.S.C. 154(b) by 321 days.

(21) Appl. No.: 16/431,625

(22) Filed: Jun. 4, 2019

Related U.S. Application Data

(60) Provisional application No. 62/681,310, filed on Jun. 6, 2018.

(51) Int. Cl.
*B65F 1/14* (2006.01)
*A47L 13/512* (2006.01)

(52) U.S. Cl.
CPC ..... *B65F 1/141* (2013.01); *A47L 13/512* (2013.01)

(58) Field of Classification Search
CPC ..... A47F 5/11; A47L 13/512; B65D 81/361; B65D 85/64; B65F 1/141
USPC ..... 248/146, 152, 174; 229/907
See application file for complete search history.

(56) References Cited

U.S. PATENT DOCUMENTS

| | | | | | |
|---|---|---|---|---|---|
| 396,467 | A | | 1/1889 | Coleman | |
| 647,327 | A | | 4/1900 | Rehlin | |
| 2,424,644 | A | * | 7/1947 | Barrett | B62B 3/104 280/79.3 |
| 2,584,219 | A | * | 2/1952 | Murrell | A47L 13/51 312/207 |
| 2,596,749 | A | * | 5/1952 | Webber | B62B 3/10 211/70.6 |
| 3,022,895 | A | * | 2/1962 | Kingsley | A47F 7/00 211/4 |
| 3,118,685 | A | | 1/1964 | Jordan | |
| 3,503,550 | A | | 3/1970 | Main et al. | |
| 3,780,874 | A | * | 12/1973 | Stacy, Sr. | A47B 81/02 211/65 |
| 3,990,601 | A | * | 11/1976 | Joyce | A47F 5/112 220/500 |
| 4,200,346 | A | | 4/1980 | Belokin, Jr. | |
| 4,576,291 | A | * | 3/1986 | Stein | A47F 1/04 211/49.1 |
| 5,139,299 | A | * | 8/1992 | Smith | B65F 1/0066 220/23.4 |
| 5,507,385 | A | | 4/1996 | Koloski et al. | |
| 5,573,115 | A | * | 11/1996 | Fuller | A47F 7/0028 206/362 |
| 5,642,898 | A | | 7/1997 | Wise | |
| 5,799,958 | A | | 9/1998 | Bishop | |
| 5,842,566 | A | * | 12/1998 | White | A47F 5/11 206/362 |

(Continued)

FOREIGN PATENT DOCUMENTS

| | | | |
|---|---|---|---|
| CA | 2358176 | A1 | 8/2005 |
| CN | 202288188 | U | 7/2012 |

*Primary Examiner* — Joshua E Rodden

(57) ABSTRACT

This invention is a multiple purpose storage bin. Its purpose is to consolidate everyday cleaning tools and other items that are used daily, such as a broom, mop, sponge mop, standard size trashcan, trash bags, reusable bags and other items at the end users preference. The bottom trashcan bin offers two sizes, small and large. The desired material it's made from but not limited too is plastic and or corrugated board laminated giving the end-user the ability to self assemble based upon their storage preference they can interchange the holding sides, style and design patterns of the bin, by exchanging the opening that holds the broom, mop or floor duster.

1 Claim, 5 Drawing Sheets

(56) References Cited

U.S. PATENT DOCUMENTS 6,086,073 A 7/2000 Tisbo et al.
6,203,036 B1 3/2001 LaVaute et al.
6,513,889 B1 * 2/2003 Park ..... A47B 81/02 312/206
6,591,990 B2 * 7/2003 Lanman ..... B43M 99/001 206/214
D489,938 S * 5/2004 Vipond ..... D7/504
6,745,434 B2 6/2004 Smith et al.
6,827,357 B2 12/2004 Calmeise et al.
6,850,208 B1 * 2/2005 Ferrante ..... G06Q 10/087 345/1.1
7,178,766 B2 * 2/2007 Forshee ..... B01F 15/00733 248/146
7,367,571 B1 5/2008 Nichols
7,467,801 B1 12/2008 Garduno
7,494,098 B1 * 2/2009 Fulda ..... B65F 1/141 220/483
7,523,598 B1 * 4/2009 Eckert ..... B63B 32/80 53/474
8,011,701 B2 * 9/2011 Taylor ..... B44D 3/00 292/256
8,025,347 B1 9/2011 Solis
8,567,616 B2 10/2013 Mishan et al.
8,800,786 B2 * 8/2014 Parkins ..... B60R 9/10 211/20
9,108,768 B2 * 8/2015 Bruno ..... A47J 47/18
9,126,736 B1 * 9/2015 Wright ..... B65F 1/141
D787,197 S 5/2017 Sirpal
9,635,916 B2 5/2017 Bezich et al.
9,676,433 B2 * 6/2017 Paulssen ..... B62H 3/04
9,936,799 B2 4/2018 Reyes
D901,814 S * 11/2020 Tsui ..... D32/52
D902,516 S * 11/2020 McDonnell ..... D32/52
2002/0056967 A1 * 5/2002 Carrillo ..... B62B 3/008 280/47.35
2003/0122331 A1 7/2003 DiGiacomo et al.
2004/0217238 A1 11/2004 Chochinov et al.
2004/0221872 A1 11/2004 Perelli et al.
2005/0061695 A1 * 3/2005 Nogin ..... A47L 13/51 206/362.3
2005/0077805 A1 4/2005 Dalebout et al.
2007/0114343 A1 * 5/2007 Slone ..... B65F 1/141 248/146
2007/0210546 A1 9/2007 Presnell et al.
2008/0302739 A1 12/2008 Van Landingham, Jr. et al.
2009/0189498 A1 7/2009 Catron et al.
2012/0312390 A1 * 12/2012 Olson ..... A47L 11/4091 137/234.6
2013/0068647 A1 * 3/2013 Mishan ..... A47L 13/51 206/374
2014/0138512 A1 5/2014 Van Rens et al.
2016/0235271 A1 8/2016 Zhu et al.

* cited by examiner

105

BOTTOM TRASHCAN BIN

BACKGROUND OF THE INVENTION

Generally holding caddies and storage bins that are designed for convenient use are designed to be put away in a closet after use are disguised as a piece of furniture to fit off in the background. Most designs for storing such cleaning items are attachable to the trashcan and cumbersome and not easily accessible, they are not designed to be sitting out among the general public and private living areas. The designs of the storage bin that or made to look like furniture are not for everyday heavy-duty areas with high traffic, most prior art has always been designed as full-sized janitorial carts and big residential apparatus that often do not fit into a common everyday area such as, kitchen, daycare, dorm rooms, salons and office areas that knows space is a priority. With this invention The Bottom Trashcan Bin can be used anywhere a common standard size trash can is in use.

Most inventors in the field of storage bins and caddies for holding cleaning tools and other items understand the importance of having them readily available for quick use. There are times when the bigger cleaning apparatus are of choice due to the amount of work that is required to be done, such as cleaning large areas, office buildings, and other bigger facilities. The prior art also shows that once stored away it limits having convenience and quick access to the cleaning tools. In this field of storage bins and caddies that are used for holding cleaning tools is commonly seen as apparatus constructed of a durable plastic and metal material to be used in heavy traffic areas and in multiple areas however, again most prior art has to be stored away after use.

The Bottom Trashcan Bin, is constructed of a durable plastic material and also corrugated board, but not limited to other raw materials. With corrugated boarding material, it allows the end-user a laminated wipe-able surface that is decorative and colorful. The pieces are interchangeable allowing a more custom décor to be set in plain view. Bottom Trashcan Bin offers the end-user the ability to put together (assemble) their storage bin, enabling them to select interchangeable cleaning tool holders slots based upon their preference. The said bin comes in two styles assemble non-assembly. The size of the storage bin is not cumbersome; the said bin is designed for a commonly used trashcan to be placed on top of the flat open bay area of the bin, between the other two storage sections. Said bin solves a problem with storage by conveniently having all cleaning items and trashcan next to one another with a modern decor compared to prior arts which are full-sized janitorial carts that result in difficulty maneuvering through pedestrian and common living areas. Most prior arts are not desirable for easy access and sitting out daily in open view to be used.

SUMMARY OF THE INVENTION

The exact nature, operation, and purpose of the invention is to allow the users to have their cleaning tools and trashcan readily available in the same area; with a more modern look to fit the environment. Another objective of this present invention is that it is constructed enabling several style and size preferences to accommodate the user accordingly providing a storage bin that has multiple functions serving the multiple needs simultaneously for quick and easy access of cleaning tools and trashcan. Also, it is to be understood that the invention is not limited in its application to the details of construction and arrangements of the components set forth in the following description and illustration. The invention is capable of other embodiments and of being practiced and carried out in various ways desirable to the end-user preference. It is also to be understood that the phraseology and terminology employed herein are for purpose of description and should not be regarded as limiting.

In view of the foregoing disadvantages known in other prior art reveals that most products or very cumbersome not pleasant to be seen in public due to the size of the cleaning apparatus, it is not desirable to be sitting out in general public are private living areas exposed with waste and frequently used cleaning tools. Therefore, these apparatus big are small without the aid of other tools to be used in completing the quick cleaning task are required to be stored in some closet that's often far off hindering the options to have the convenience of such tools and trashcan to be used for quick clean-ups and convenient storage.

Bottom Trashcan Bin is perfect for visible areas such as Residential homes, Commercial offices Small storefronts, Restaurants, Doom rooms, Nurses' stations, Salons, and Babar Shops, any place where a standard trashcan is in use. The need for conveniently having a bin that's out in the opening of commonly used areas that's decorative, modern looking, and accommodates the trashcan stored between the cleaning tools in order to be used simultaneously by the general public are private living areas for cleaning purposes is a true need. Therefore anyone in this field would see how the Bottom Trashcan Bin is a resolution to resolve this problem, most of the prior art is not designed to be set out in public view.

Describing more in detail; Bottom Trashcan Bin is simply a space-saving bin that allows end-user the option to consolidate their cleaning tools and other preferred items. The said bin product offers assemble and non-assembles styles. The said bin assemble style offers a small box bin on the left and one interchangeable holding slot on the right and or two holding slots left and right. Once the said bin is assembled you can't change out its parts. The said bin interchangeable holding slot comes in two shapes circle, and square; the said bin square shape has a lid to it. Both said bin product assemble and non-assembles styles offer storage area on the life side of the said bin, accommodating cleaning tools and other storable items such as trash bags, reusable bags, and dustpan whatever the preference is for that end-user is what they can decide to put in their bin. In the middle of the said bin, a commonly used trashcan is placed and stored on top of the flat bay area supporting the stability of the bin.

The said bin non-assemble is larger in size, and stores four are more items. The said bin also has an opening underneath it that accommodates a commonly used long handle dustpan that slides into place underneath the storage bin. The said bin's right side accommodates a commonly used broom being slid into its storage holding slot.

The said bin, assemble style left-size square shape storage bin has a lid which is designed to hold a mop and are sponge mop in an upright position once the lid is closed. The said bin's other side has a holding slot that is designed tightly close together which forms an opening for a commonly used broom and or floor duster to be slid into place for storage.

Another aspect of the said bin invention is that the design is very modern it is highly functional. The said bin design allows the cleaning tool handles to be in an upright position making it easy for the user to reach for the handles conveniently and simultaneously pull the cleaning items out of the bin, using them, and easily restoring them back into their storage places. The said bin allows a commonly used trash can that sits in the flat open bay area making it conveniently easy to dispose of the trash right in the same place you are storing your broom and dustpan.

Bottom Trash can bin non-assemble style has a shelf on the inside of the bin, the said shelf is horizontally designed with two sides, allowing the back part of shelf for trash bags and are reusable bags. The said bin has a lid that is attached and secures to the bin; the said lid is designed with an open vent dispenser formed into the top cavity of the lid, the said vent dispenser is used to pull the trash bags or reusable bags through open vent dispenser that is formed in the top cavity of said lid.

This invention Bottom Trashcan Bin has two sizes assembled and non-assemble. The said bin assemble size measures 23×11×11 and supports three items; the said bin non-assemble size is larger and measures 29×16×11 supports five are more items.

The bottom trashcan bin is used for everyday cleaning tools and gives the option for you to assemble and customize its use. By consolidating all items that will be used in the everyday cleaning, drops, knock over's, spills, you will be ready. By customizing the bottom trashcan bin you are equipped to get the job done, rather big are small, due to the custom ability to assemble how you want to use your bin, from paper towels, rags, all types of items and holding spaces that can be used in the bin it is the end-users choice of daily cleaning tools and other items to be stored.

With the Bottom trashcan bin, the bristles of brooms, mops, or sponge mops and dustpans are conveniently not as exposed as some apparatus are. Most caddies are storage bins that have cleaning tools sitting on top of the apparatus with nothing covering them. The bottom trashcan bin improved conception upon which this disclosure is based may readily be utilized as a basis for the design of other structures, methods, and systems for carrying out the purposes of the Bottom Trashcan Bin. These and other features, aspects, and advantages of the present invention will become apparent from the following description, appended claims, and the accompanying exemplary embodiments shown in the drawings, which are briefly described below.

BRIEF DESCRIPTION OF THE DRAWINGS

Those skilled in the art will appreciate the improvements and advantages that derive from the present invention. The accompanying drawings illustrating the invention will be Identifying the Bottom Trashcan Bin and together with the description, serve to explain principles of the invention.

FIG. 5*a* Non-assemble bin front view of left box bin, right side holding slot.

FIG. 5*b* 45 degree angle of bin with a commonly used dust pan being stored.

FIG. 5*c* displays commonly used trashcan sitting on flat open bay area of bin.

FIG. 5*d* 45 degree angle displaying the storage of a sponge mop and dust pan.

FIG. 5*e* Top and bottom of double sided lid that fits on top of the storage bin.

DETAILED DESCRIPTION OF THE INVENTION

Figure 1B:
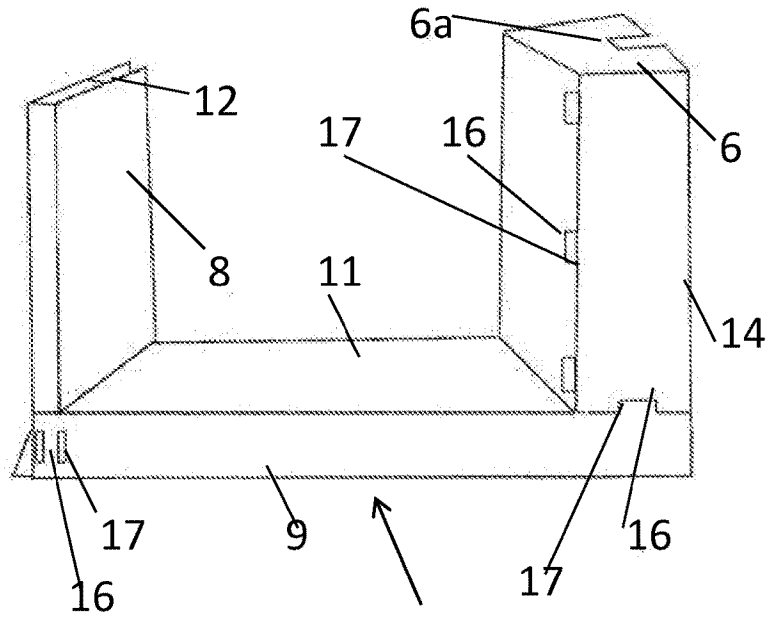
FIG. 1*b* backside view of assemble style bottom trashcan bin.

Referring now to more detail specifically to the Figures to which similar or identical parts will be identified by reference numerals. The accompanying drawings illustrating the invention will be Identifying the Bottom Trashcan Bin and together with the description, serve to explain principles of the invention.

Figure 1A:
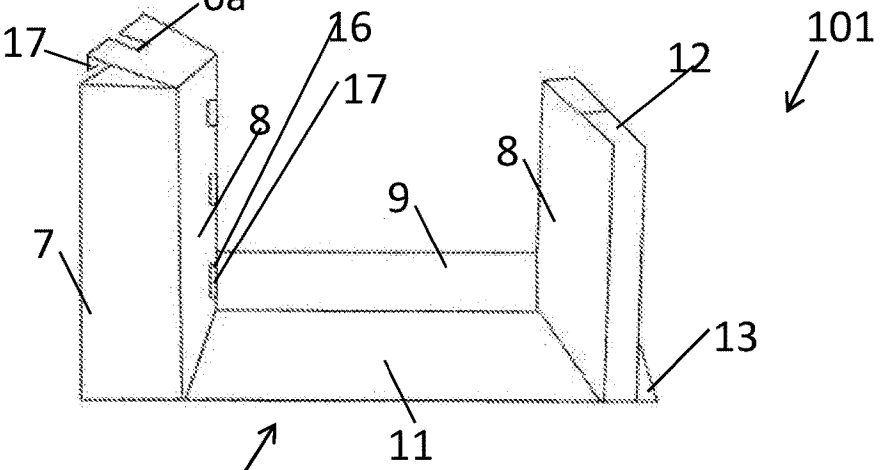
FIG. 1*a* front view of the assemble style of bottom trashcan bin.
Figure 1C:
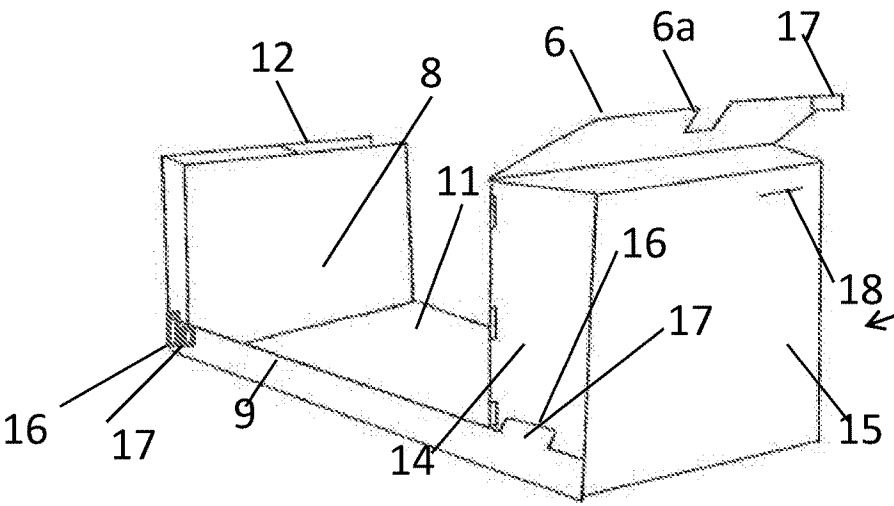
FIG. 1*c* Side view of assemble style bottom trashcan bin.
Figure 2B:
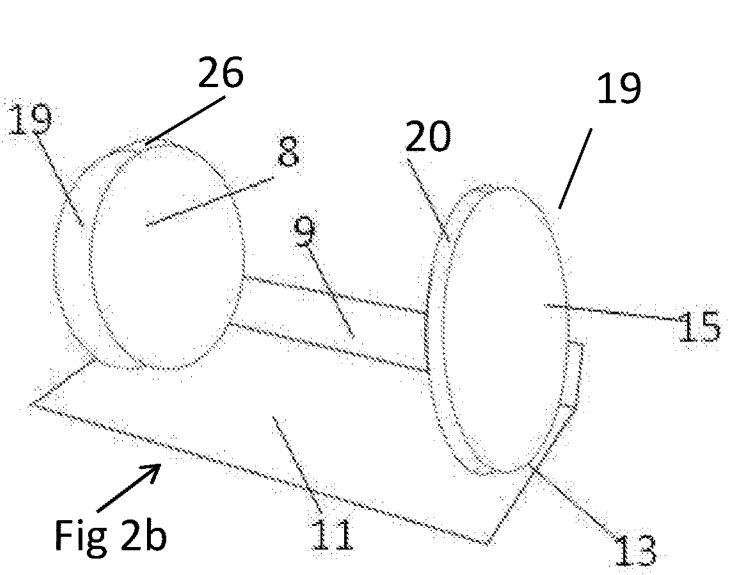
FIG. 2*b* Circle shape storage bin assembled.
Figure 2A:
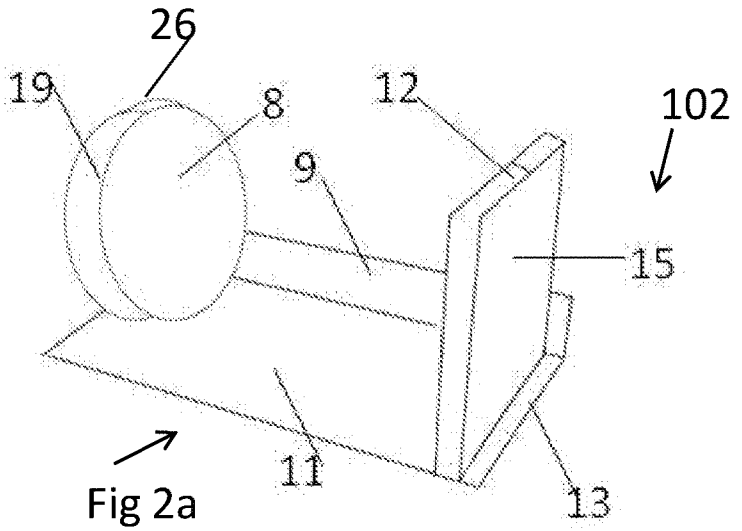
FIG. 2*a* square shape storage bin assembled.
Figure 2C:
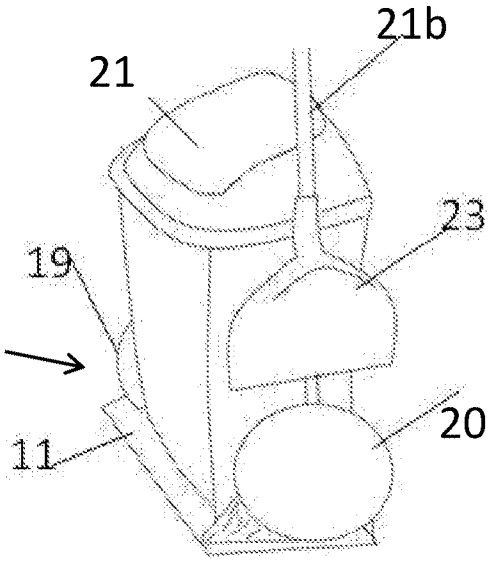
FIG. 2*c* displays commonly used trash can, broom and dust pan being stored.
Figure 2D:
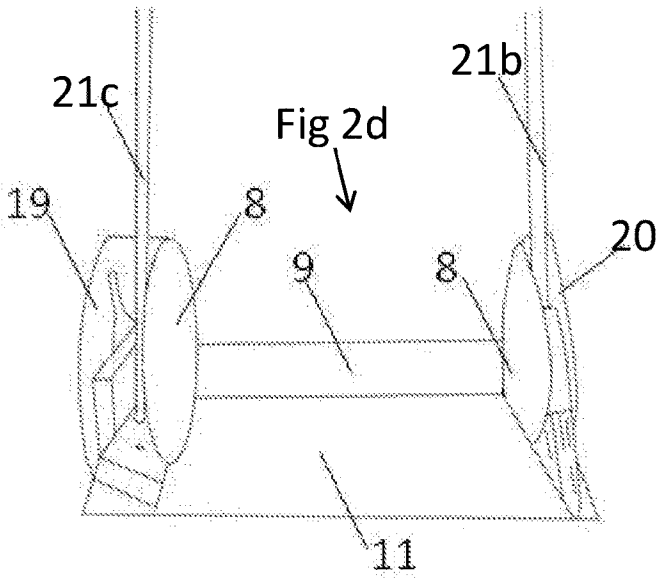
FIG. 2*d* Circle shape storage bin with sponge mop and broom being stored.
Figure 3B:
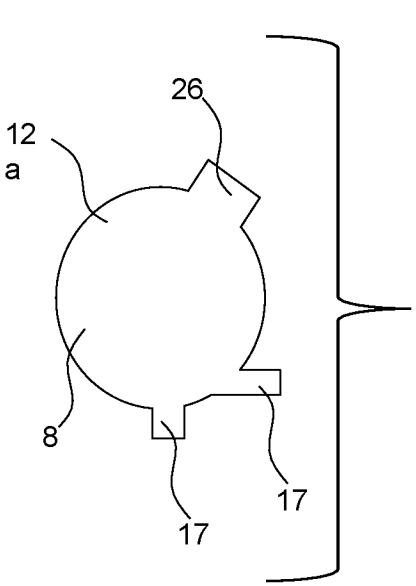
FIG. 3*b* (12*a* Circle holder).
Figure 3B:
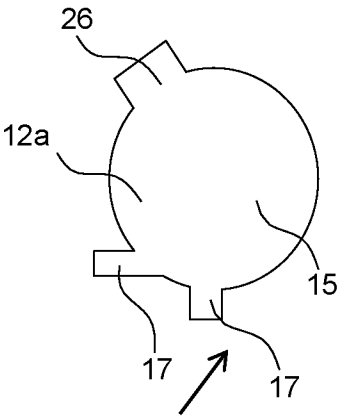
Figure 3C:
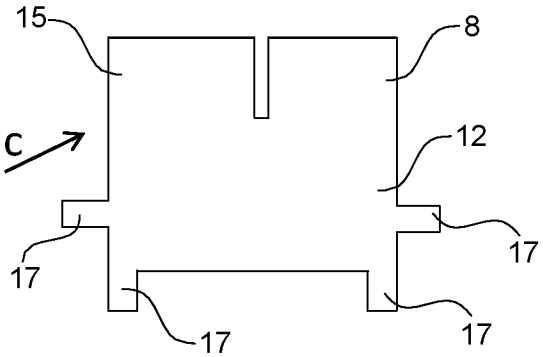
FIG. 3*c* (12 Square holder).
Figure 3A:
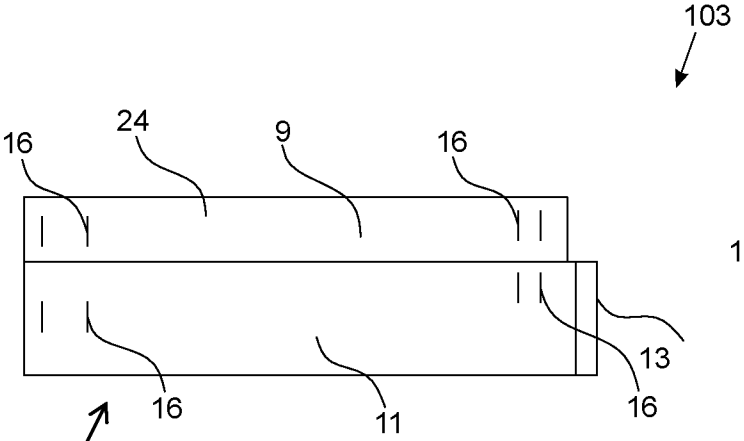
FIG. 3*a* shows (24 the exchangeable bay area floor).
Figure 3D:
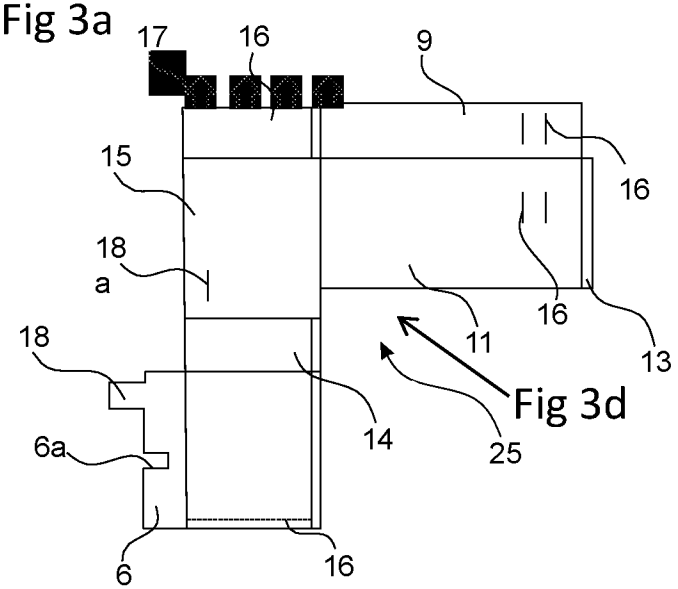
FIG. 3*d* (25 assemble box bin with lid).

Referring now to drawing FIG. 1*a*-1*c*, it shows the small size 23×11×11 square shape storage bin, 101 assemble storage bin, 6 is the lid with an opening 6*a* is the secure slot made to supports a long handle cleaning tool such as mop, or sponge mop, once tool is in place and lid is closed the secure slot 6*a* holds long handle in upright position. 7 is front wall of bin, 8 sided inter wall, 9 back splash, 11 bay area is where the trash can sit, 12 square holder which is where the broom slides into, 13 foot hold is where you place your foot to support bin as you pull out broom. 14 back wall of bin, 15 outer side wall, 16 16 secure slit is a opening that allows the secure tab 17 to be inserted for assembling the storage bin, secure tabs 17 are all tabs that are on the bin to be assembled by way of folding and adhesive. 18 is a guard tab that's a part of the lid and works as a securing device by using 18*a* and 18*a* is a secure guard slit that allows 18 guard tab to slide into the secure slit opening of 18*a* holding it in place keeping the lid close.

Referring now to drawing FIG. 2*a*-2*d* assemble storage bin. These perspective views are showing the different styles of the Small circle and square shape storage bin. Sided inside wall 8, 9 back splash, 11 bay area is where the trash can sit, 21 is a perspective size view showing how a standard trashcan looks place in the bay area 11, 21, number 12 square holder opening is where the broom slides into, 13 foot hold is where you place your foot to support bin as you pull out broom, 15 outer side wall, 19 circle sponge mop holder opening, this is where a regular sponge mop is stored, 21*c* shows how the sponge mop looks stored in place, 20 circle broom holder opening this is where the broom slides in and stored, 21*b* just shows how the broom looks in circle broom holder 20, 23 shows how a standard dust pan attached to the broom handle looks in place.

Referring now to drawing FIG. 103 assemble storage bin. This is a view of the exchangeable small storage bin parts. 24 is an exchangeable bay area floor that allows customizing the storage bin. 6 is the lid, 6*a* is the secure slot made to supports a long handle cleaning tool, 8 sided inter wall, 9 back splash, 11 bay area is where the trash can sit, 12 is the square holder and 12*a* is the circle holder. 13 foot hold is where you place your foot to support bin as you pull out broom. 14 back wall of bin, 15 outer side wall, 16 secure slit is a opening that allows the secure tab 17 to be inserted for assembling the storage bin.

Going into more detail on putting the small storage bin together; by inserting anyone of the holders secure tabs 17 into the secure slit 16 located on the right side of the exchangeable bay area floor 24, and sealing with an adhesive as directed forms a holder for a broom are a dust broom. On the left side of the exchangeable bay area floor using 12*a* circle holder, inserting secure tabs 17 into secure slits 16 and sealing with an adhesive forms the sponge mop holder, which space is wider than the broom holder, and seal with an adhesive. Take 12*a* circle holder and on Top 26 apply adhesive only to the right side as instructed and seal together with left side forming the top of 12*a* circle holder see FIG. 2*a*-2*d*. 25 is the assemble box bin with lid, assembling is very easy for the end-user, the scored folds are already in place allowing the corrugated boxing to fold easily once folded then you inserting secure tabs 17 into secure slits 16 seal with adhesive as instructed. 18 is a guard tab that's a part of the lid and works as a securing device by using 18*a* which is a secure guard slit that allows 18 guard tab to slide into the secure guard slit opening of 18*a* holding it in place keeping the lid close.

Figure 4B:
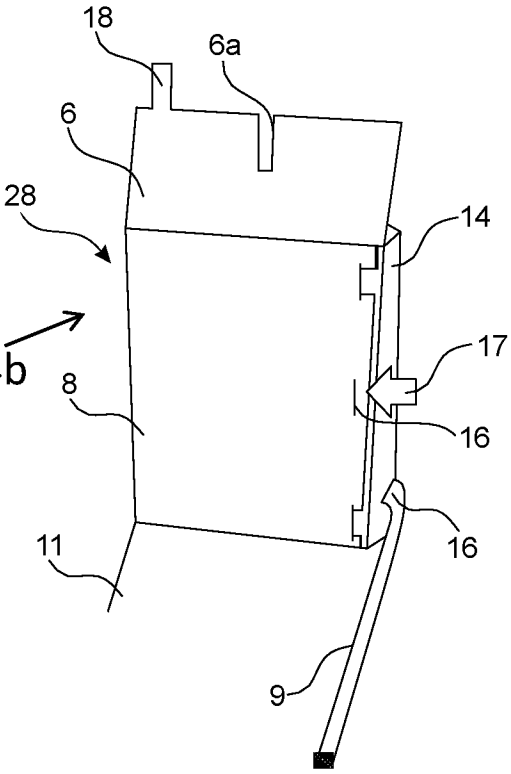
FIG. 4*b* inserting tabs.
Figure 4A:
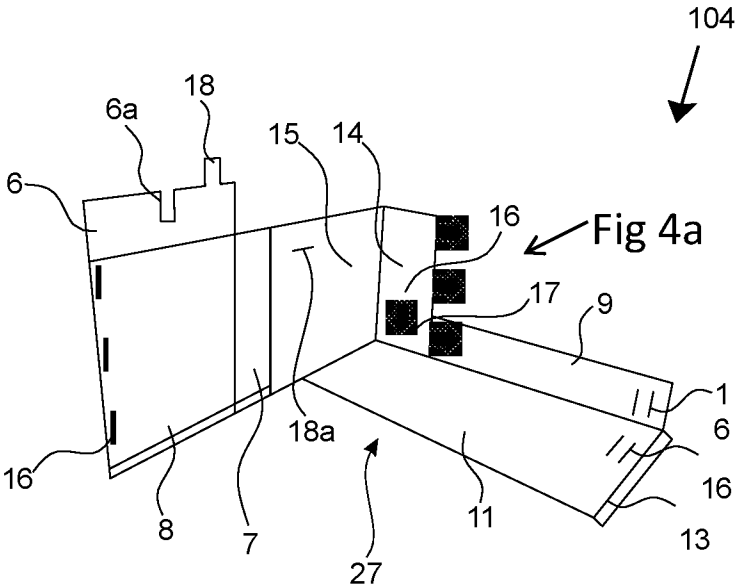
FIG. 4*a* Assemble box bin being folded and position for inserts.
Figure 4C:
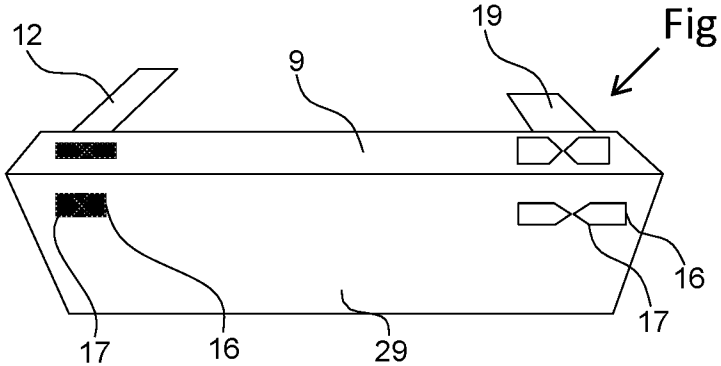
FIG. 4*c* finished inserted tabs.

Referring now to drawing FIG. 4*a*-4*c* assemble storage bin; shows a illustration of how the Small bin tabs are assembled, 27 is a view of the box bin folded upright forming the back splash 9 with the attached secure tab 17 inserted into a secure slit 16 and sealed. 28 view shows three inserted secure tabs 17 and a view how it looks for the secure slit 16 lined up with 17 secure tab to be inserted. 29 view is a partial perspective to show how the tabs are folded and sealed once inserted. 6 is the lid an opening 6*a* is the secure slot made to supports a long handle cleaning tool such as mop, or sponge mop, once tool is in place and lid is closed the secure slot 6*a* holds long handle in upright position. 7 is front wall of bin, 8 sided inter wall, 9 back splash, 11 bay area is where the trash can sit, 12 square holder which is where the broom slides into, 13 foot hold is where you place your foot to support bin as you pull out broom. 14 back wall of bin, 15 outer side wall, 16 16 secure slit is a opening that allows the secure tab (17) to be inserted for assembling the storage bin. 18 is a guard tab that's a part of the lid and works as a securing device by using 18*a* and 18*a* is a secure guard slit that allows 18 guard tab to slide into the secure slit opening of 18*a* holding it in place keeping the lid close. 19 circle sponge mop holder opening, this is where a regular sponge mop is stored.

Figures 5A, 5B, 5C, 5D, 5E:
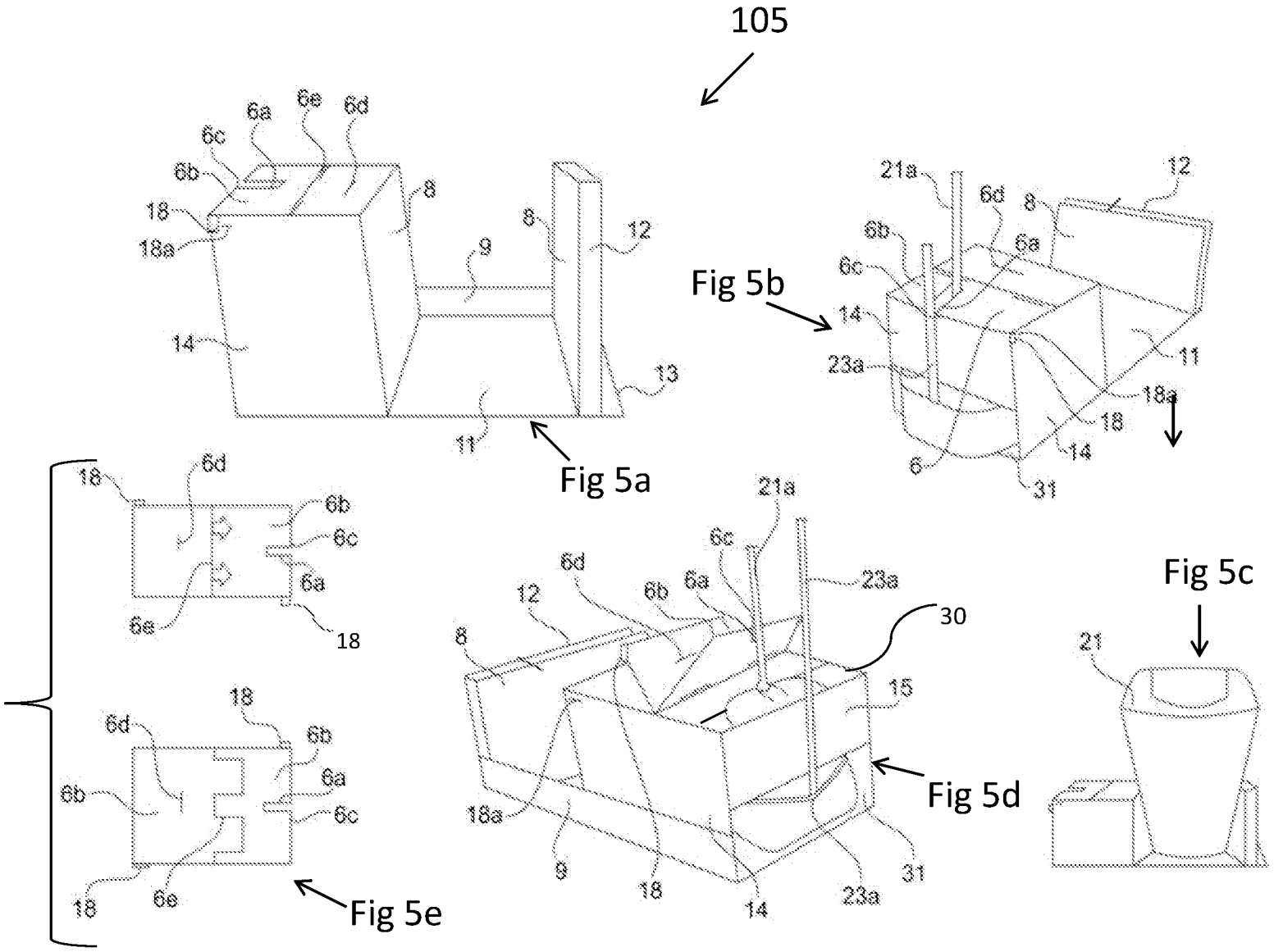

Referring now to drawing FIG. 5*a*-5*e* non-assembled storage bin shows the larger storage bin 29×16×11. The left of FIG. 5*a* is the front view, to the right is a partial view, at the bottom is a back side partial view, and the lower right is the view of a trashcan sitting in the bay area of the storage bin. The difference in the small and large bin is size, the large has the ability to storage up to five are more items and the lid has three function. 7 is front wall of bin, 8 sided inter wall, 9 back splash, 11 bay area is where the trash can sit, 12 square holder which is where the broom slides into, 13 foot hold is where you place your foot to support bin as you pull out broom. 14 back wall of bin, 15 outer side wall.

More detail on lid; 6*b* is the double sided lid for the larger storage bin. 6*a* is the secure slot that once cleaning tool has been placed in the bin and lid 6*b* is closed the secure slot 6*a* holds the handle of the cleaning item in place keeping it upright and ready for use, 6*c* is a little extended leverage of the lid that secures the long handle dust pan. Going into more detail; 30 shows a divided shelf on the inside to place trash bags, re-usable bags and cleaning items that the end user prefers. 31 With the large size storage bin it has a bottom slot that is used to store a long handled dust pan, sliding the dust pan into the bottom slot stores it there, closing the lid 6*b* allows the extended leverage 6*c* to secure the long handle dust pan. The 6*b* lid also has a vent dispenser 6*d* which is formed in the cavity of the lid it allows the trash bags to be feed through by pulling out one bag at a time without having to lift with lid.

I claim that:

1. A bottom trashcan bin for providing storage and holding cleaning tools, and allowing a trashcan to sit upon as said bottom trashcan bin separates and consolidates the cleaning tools inside the bottom trashcan bin, said bottom trashcan bin comprising:

a flat floor base forming a flat bay area floor that extends from a left side to a right side of the flat floor base, and with interchangeable pieces configured to be attached to the flat floor base for customizing the flat floor base; said interchangeable pieces including a plurality of side box shaped storage bins including a single compartment side box shaped storage bin and a double compartment side box shaped storage bin having a divided vertical storage shelf inside, an underneath storage slot, a double-sided attached lid that extends over a top of the double compartment side box shaped storage bin, said double-sided attached lid has an open slot formed into a cavity of the lid configured so that once the lid is closed it is configured to secure cleaning tool handles once placed inside said divided vertical storage shelf, said double-sided attached lid has an open vent dispenser formed into the cavity of the lid, and a guard tab for keeping the lid closed, and a plurality of storage holding slots in the form of square storage holding slots and circular storage holding slots;

said flat floor base and said interchangeable pieces being configured to be assembled into a first configuration, the first configuration having said flat floor base having said single compartment side box shaped storage bin attached to the left side of the flat floor base, and one of the plurality of the side storage holding slots attached adjacent to the right side of the flat floor base, said bay area floor forms an open area in between said single compartment side box shaped storage bin and the side storage holding slot, with a foot holder that extends on the flat floor base beyond the side storage holding slot on the right side of the flat floor base;

said flat floor base and said interchangeable pieces being configured to be assembled into a second configuration, the second configuration having said double compartment side box shaped storage bin attached to the left side of the flat floor base, and one of the storage holding slots being located adjacent a right side of the flat floor base;

said flat floor base and said interchangeable pieces being configured to be assembled into a third configuration, the third configuration having one of the storage holding slots attached to the left side of the flat floor base, and another one of the storage holding slots being located adjacent a right side of the flat floor base;

the flat floor base has plurality of secure slits formed into the bay area floor, and the flat floor base has a backside with said backside having a plurality of secure slits formed into the backside, and said bay area floor has the foot holder;

the square storage holding slots have a plurality of secure tabs formed on the edges thereof, the secure tabs are configured to be inserted into corresponding ones of the secure slits of the bay area floor and said backside;

the plurality of circular storage holding slots having a plurality of secure tabs formed on edges thereof, the tabs are configured to be inserted into corresponding ones of the secure slits of the bay area floor and said backside, said circular storage holding slots being a two-part circle holder having a top that is formed outwardly and connects together with adhesive;

the bottom trashcan bin is configured to cover exposed workable cleaning tool heads, including mop's brooms, sponge mops long-handle dustpans.

* * * * *